United States Patent [19]

Arcilesi et al.

[11] 4,204,013

[45] May 20, 1980

[54] METHOD FOR TREATING POLYMERIC SUBSTRATES PRIOR TO PLATING EMPLOYING ACCELERATING COMPOSITION CONTAINING AN ALKYL AMINE

[75] Inventors: Donald A. Arcilesi, Mt. Clemens, Mich.; Warren R. Doty, Los Alamos, N. Mex.

[73] Assignee: Oxy Metal Industries Corporation, Warren, Mich.

[21] Appl. No.: 953,153

[22] Filed: Oct. 20, 1978

[51] Int. Cl.[2] ..... C23C 3/02

[52] U.S. Cl. ..... 427/304; 106/1.11; 156/668; 427/305; 427/306; 427/307

[58] Field of Search ..... 427/304–307; 106/1.11; 156/668

[56] References Cited

U.S. PATENT DOCUMENTS

| | | | |
|---|---|---|---|
| 3,011,920 | 12/1961 | Shipley | 427/304 |
| 3,532,518 | 10/1970 | D'Ottavio et al. | 427/304 |
| 3,622,370 | 11/1971 | D'Ottavio et al. | 427/304 |
| 3,962,497 | 6/1976 | Doty et al. | 427/306 |
| 4,153,746 | 5/1979 | Kilthau | 427/304 |

*Primary Examiner*—John D. Smith

*Attorney, Agent, or Firm*—Richard P. Mueller

[57] ABSTRACT

A process for treating a polymeric plastic substrate to render it receptive to electroless plating including the steps of etching the substate, rinsing and activating the etched substrate with an acidic tin-palladium complex, rinsing and thereafter accelerating the activated substrate employing an improved aqueous accelerating solution containing an aqueous soluble compatible substituted alkyl amine. The improved accelerating solution is stable, easy to control, tolerant to metallic impurities present in the solution, inhibits rack plating and is of versatile use.

10 Claims, No Drawings

METHOD FOR TREATING POLYMERIC SUBSTRATES PRIOR TO PLATING EMPLOYING ACCELERATING COMPOSITION CONTAINING AN ALKYL AMINE

BACKGROUND OF THE INVENTION

A variety of methods have heretofore been used or proposed for use in applying metallic platings to all or portions of the surfaces of polymeric plastic parts. Such processes conventionally comprise a plurality of sequential pre-treatment steps to render the plastic substrate receptive to the application of an electroless plating whereafter the plated part can be processed through conventional electroplating operations to apply one or a plurality of supplemental metallic platings over all or selected portions of the plastic substrate. Conventionally, the pre-treatment steps employed include a cleaning or series of cleaning steps, if necessary, to remove surface films or contaminating substances followed thereafter by an aqueous acidic etching step employing a hexavalent chromium solution to achieve a desired surface roughness or texture enhancing a mechanical interlock between the substrate and the metallic plating to be applied thereover. The etched substrate is subjected to one or a plurality of rinse treatments to extract and remove any residual hexavalent chromium ions on the surfaces of the substrate which may also include a neutralization step including reducing agents to substantially convert any residual hexavalent chromium ions to the trivalent state. The etched substrate is thereafter subjected to an activation treatment in an aqueous acidic solution containing a tin-palladium complex to form active sites on the surface of the substrate followed by one or more rinsing steps after which the activated surface is subjected to an accelerating treatment in an aqueous solution to extract any residual tin constituents or compounds on the surface of the substrate. The accelerated plastic part is again water rinsed and thereafter is subjected to an electroless plating operation of any of the types known in the art to apply a metallic plate such as copper, nickel or cobalt over all or certain selected areas thereof whereafter the part is rinsed and thereafter is subjected to conventional electroplating operations.

Typical of such plastic plating processes are those described in U.S. Pat. Nos. 3,622,370; 3,961,109; and 3,962,497 to which reference is made for further details of the process. The present invention is also applicable to processes of the foregoing type and is specifically directed to an improved aqueous accelerating solution which provides benefits and advantages heretofore unattainable in accordance with prior art practices.

A continuing problem associated with the electroplating of polymeric substrates has been in the careful control of the activation and accelerating steps to achieve a plastic substrate which is receptive to the subsequent electroless plating solution to provide 100% coverage of a conductive metal layer which is adherent to the substrate and which is devoid of any lack of continuity of coverage or "skipping". The presence of such discontinuities or skips results in plastic parts which upon subsequent electroplating contain non-plated areas or non-uniformity in the metallic plating deposit rendering them unsuitable for the intended end use.

It has been observed that etched and activated plastic substrates employing a tin-palladium complex activator which have not been accelerated or which have been subjected to an accelerating treatment in a weak accelerator will not become plated or will only become partially plated in the subsequent electroless plating step. Such parts are ordinarily referred to as being "under accelerated". On the other hand, when such parts are accelerated in an accelerating solution that is too strong or too aggressive, electroless plating is also adversely effected as evidenced by discontinuity or skips and in some instances no plating deposit at all. In such instances, the parts are referred to as being "over-accelerated". It is important, accordingly, that the accelerating solution employed be carefully controlled so as to provide the requisite degree of acceleration in order to achieve uniform continuous electroless plating deposits on a consistent basis.

It has been observed that accelerating solutions of the types heretofore known are extremely sensitive to the presence of contaminating metal ions carried over from other processing steps or inherently present in the accelerating solution. For example, hexavalent chromium ions in spite of vigorous rinsing and neutralization steps nevertheless are carried over into the subsequent accelerating solution by entrapment in the plastic parts being processed as well as by bleed-through from cracks or openings in the protective plastisol coating conventionally employed over portions of the work racks. Tin compounds similarly are carried over from the prior activation step which adversely affect the accelerating treatment. The presence of ferric and cupric ions in relatively low concentrations such as only 10 ppm and 20 ppm, respectively, have been found to significantly alter the agressiveness of the accelerating solution rendering it unsuitable for further use. Ferric ions constitute a normal contaminant in the water employed for preparing the several aqueous solutions and are further introduced by the dissolution of the stainless steel components of the work rack on which the plastic parts are suspended. Additionally, ferric ions are introduced by oxidation attack of the steel tanks through imperfections in the protective plastic coating which enter the solution and also by conventional rust present in the plating environment. Copper ions similarly are introduced through the water system including copper pipeline, the copper bus bars adjoining the treating receptacles, a dissolution of the rack splines as well as from carryover and bleed-out from the racks as a result of the presence of residual copper on the racks resulting from copper plating operations. Such residual contamination of the racks cannot be completely eliminated in spite of vigorous stripping of the racks at the conclusion of each plating cycle. In many instances, ferric and cupric ion contamination is also introduced as inherent impurities in the chemicals employed to make up the several solutions including the accelerator solution.

In any event, the presence of such ferric cupric, and hexavalent chromium ions in only relatively minimal amounts has adversely effected the accelerating treatment and heretofore has occasioned a discarding and replacement of the aqueous accelerating solution after only a short period of operation.

The present invention overcomes the problems and disadvantages associated with processes for the plating of plastic articles, and particularly the acceleration thereof, by providing a solution which is stable, which is easy to control, which is tolerant to such conventional metallic impurities present, which will further inhibit plating on the protective plastic rack coating, and which is of versatile use over a variety of conventional platable plastic materials.

SUMMARY OF THE INVENTION

The benefits and advantages of the present invention are achieved by a process in which a polymeric plastic substrate is treated to render it receptive to electroless plating and includes the steps of etching plastic substrate with an aqueous acid solution containing hexavalent chromium ions whereafter the etched substrate is rinsed one or a plurality of times. The resultant etched substrate is thereafter activated with an acidic tin-palladium complex and is rinsed. The activated plastic substrate thereafter is contacted with an improved accelerating solution containing an aqueous soluble compatible substituted alkylamine which is present in an amount effective to complex substantially all of any contaminating reducible metal ions present, such as cupric and ferric ions, to extract any residual tin constituents present on the surface of the activated substrate. Conventionally, the substituted alkyl amine can be present in an amount of about 0.001 to about 100 g/l with amounts of about 0.01 to about 10 g/l being preferred. The aqueous amine containing accelerating solution further contains ions of mineral acids and/or aqueous soluble alkali salts thereof in amounts up to 120 g/l, and may additionally include a reducing agent for reducing agent for reducing any hexavalent chromium present to the trivalent state and may also contain a surfactant to provide a more uniform surface reaction.

The process employed the accelerating solution can be performed from about room temperature up to about 160° F. with temperatures ranging from about 135° F. to about 150° F. being preferred. Time periods of about 30 seconds up to about 5 minutes are usually satisfactory which will vary depending upon the type of plastic substrate, the degree of activation thereof, the temperature of the activating solution and related variables. The activating solution is operated in the acidic range of pH 0 up to about neutral and preferably less than pH 1.

Additional benefits and advantages of the present invention will become apparent upon a reading of the detailed description of the preferred embodiments taken in conjunction with the accompanying examples.

DESCRIPTION OF THE PREFERRED EMBODIMENTS

The process of the present invention is applicable for use with any of the various platable plastic or polymeric plastics including acrylonitrile-butadiene-styrene (ABS), polyaryl ethers, polyphenylene oxide, nylon and the like. The polymeric plastic parts are usually subjected to a cleaning treatment to remove any surface contamination which may further include an organic solvent treatment, in some instances, to render the substrate hydrophilic during the subsequent chromic acid etching step. Usually the cleaning step is performed employing an aqueous alkali soak solution followed by contact in an organic solvent medium which may comprise either a single-phase system or an aqueous-organic solvent emulsion. The clean part is thereafter thoroughly water rinsed and is next subjected to an etching treatment in an aqueous acid solution containing hexavalent chromium ions and acid, such as sulfuric acid, to effect an etching of the surface thereof. The specific concentration of the etching solution, the temperature, and the duration of treatment will vary depending upon the specific type of plastic substrate and the parameters of the etching step are, accordingly, dictated by procedures well known and practiced in the art.

Following the etching step, the etched polymeric substrate is subjected to one or more cold water rinses and may additionally include a neutralization step employing an aqueous solution containing a reducing agent to effect a reduction of any residual contaminating hexavalent chromium ions to the trivalent state. A typical neutralization treatment is described in U.S. Pat. No. 3,962,497, the teachings of which are incorporated herein by reference. Following neutralization, if employed, the substrate is again water rinsed and thereafter is subjected to an activation treatment employing an aqueous acid solution containing a tin-palladium complex of the various types well known in the art. A typical one-step activation treatment is described in U.S. Pat. No. 3,011,920 and U.S. Pat. No. 3,532,518, the substance of which is incorporated herein by reference.

Following the activation treatment, the activated polymeric substrate is subjected to one or a series of separate cold water rinse treatments whereafter it is subjected to acceleration in an aqueous solution in accordance with the practice of the present invention as more fully hereinafter to be described. Following acceleration, the part is cold water rinsed and thereafter is subjected to an electroless plating to apply a conductive continuous and adherent metallic plating such as copper, nickel, or cobalt over all or selected surface areas thereof. The electroless plating step is performed in accordance with well known and established practices employing an aqueous solution containing a reducing agent and a reducible salt of the metal to be deposited on the surface. Following the electroless plating step, the part is subjected to one or a plurality of water rinse treatments and is thereafter in condition for conventional electroplating employing normal procedures to apply one or a plurality of overlying plating on the polymeric substrate.

In order to achieve selective plating of only certain areas of polymeric plastic articles, it is conventional either prior to or following the cleaning step to apply a stop-off coating to those areas which are not to be plated. Any of the commercially available stop-off compositions can be employed for this purpose. The present invention also provides benefits in this regard by achieving proper acceleration of the plastic substrate to be plated while inhibiting or substantially completely eliminating plating on such stop-off areas.

The accelerating solution of the present invention comprises an aqueous solution containing as its essential constituents an aqueous soluble compatible substituted alkyl amine which may be present in an amount of 0.001 up to about 100 g/l, and preferably from about 0.01 to about 10 g/l. The substituted alkyl amine is further characterized as one which is compatible with the palladium constituent on the plastic surface as well as the polymeric material itself and which is effective to form complexes with any ferric and cupric ions present thereby reducing their oxidation potential and preventing oxidation of the palladium constituent on the substrate. The substituted alkyl amine further includes the alkali metal salts thereof as well as derivatives thereof. The term "alkali metal" is used herein in its broad sense to include ammonium as well as the alkali metals.

Typical of the substituted alkyl amines which are suitable for use in the practice of the present invention are:

Glycine;

[$NH_2CH_2COOH$]

Alanine;

[$CH_3CH(NH_2)COOH$]

Aspartic Acid;

[$COOHCH_2CH(NH_2)COOH$]

Glutamic Acid;

[$COOH(CH_2)_2CH(NH_2)COOH$]

Cystine;

[$HOOCCH(NH_2)CH_2SSCH_2CH(NH_2)COOH$]

Nitrilodiacetic Acid;

[$HN(CH_2COOH)_2$]

Triethanolamine;

[$N(CH_2CH_2OH)_3$]

Nitrilotriacetic Acid;

[$N(CH_2COOH)_3$]

N-Hydroxyethylenethylenediamenetetraacetic Acid, (HEDTA);

[$HOOCCH_2N(CH_2CH_2OH)(CH_2)_2N(CH_2COOH)_2$]

Ethylenediaminetetraacetic Acid, (EDTA);

[$(HOOCCH_2)_2NCH_2CH_2N(CH_2COOH)_2$]

N,N,N',N'-Tetrakis (2-Hydroxypropyl) Ethylene Diamine;

[$(CH_3CHOHCH_2)_2NCH_2CH_2N(CH_2CHOHCH_3)_2$]

Diethylenetriamine Pentaacetic Acid;

[$(HOOCCH_2)_2NCH_2CH_2N(CH_2COOH)CH_2CH_2N(CH_2COOH)_2$]

Of the substituted alkyl amines suitable for use in the practice of the present process EDTA comprises the preferred material including the mono, di, tri and tetra alkali metal salts thereof.

The foregoing amines or classes of amines can be further categorized by the following general structural formula:

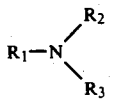

Wherein:

$R_1$ is an organic radical $$[R\overset{|}{C}HCOOH],\ [R\overset{|}{C}HCH_2OH],\ +CH_2CH_2N_R\underset{x}{+}R,$$

$$\text{or } [HOO\overset{|}{C}CH\ CH_2(S)_yCH_2CHNH_2COOH]$$

in which x and y = 1 to 4;

R, $R_2$ and $R_3$ is H or $+CH_2]_zX$ in which z = 1 to 6 and X is —OH, —$SO_3H$, —COOH, —$NH_2$, halide, —$CH_3$, or —$OCH_3$, as well as the alkali metal salts of the foregoing.

The aqueous accelerating solution, in addition to the substituted alkyl amines, further includes, as an essential constituent, mineral acids and/or aqueous soluble salts thereof which are compatible with the other constituents of the accelerating solution as well as the plastic substrate. Included among the such mineral acids are acids such as halogen acids including hydrochloric, hydrobromic, hydrofluoric and fluoroboric of which hydrochloric constitutes the preferred acid. Additionally, acids such as sulfuric acid can also be employed as well as alkali metal bisulfates to introduce sulfate and bisulfate ions in the accelerating solution. Nitric acid and the alkali metal salts thereof and phosphoric based acids and the alkali metal salts thereof are also suitable for use. The presence of such anions further facilitates the extraction and solubilization of the residual tin compounds or constituents on the surfaces of the activated polymeric substrate. Typically, at least a portion of the halogen and sulfate anions can be introduced by way of salts such as sodium chloride, sodium sulfate, sodium bisulfate, and the like. Conventionally, the inclusion of such supplemental acid constituents can be made to provide a pH of the resultant accelerating solution ranging from 0 up to about neutral, and preferably a pH of less than 1. The total concentration of the acid anions is usually controlled within a range up to about 120 g/l, with concentrations of about 40 to about 90 g/1 being preferred. When fluoride and/or nitrate anions are employed, their total concentration in the solution should not exceed about 10 g/l because of their relatively high activity toward the plastic substrate.

In accordance with a further embodiment of the present invention, it is preferred to further incorporate a controlled effective amount of a reducing agent in the aqueous accelerating solution for the purpose of reducing any residual hexavalent chromium ions to the trivalent state. Suitable reducing agents include those which are compatible with the other accelerating solution constituents and include reducing sugars, hydrazine, oxalate, alkali metal hypophosphites, hydroxylamine salts, and the like. Of the foregoing, hydroxylamine salts of the type disclosed in U.S. Pat. No. 3,962,497 including hydroxylamine hydrochloride, [$NH_2OH.HCl$], hydroxylammonium acid sulfate, [$NH_2OH.H_2SO_4$], hydroxylammonium sulfate, [$(NH_2OH)_2.H_2SO_4$] and related compounds constitute the preferred reducing agent. Such reducing agents can usually be employed in amounts of about 0.005 up to about 10 g/l.

In accordance with a further preferred embodiment of the present invention, the aqueous acid solution can contain a controlled amount of a surfactant to increase uniformity of reaction with the substrate achieving a more uniform acceleration thereof. Surfactants suitable for use include any of those well known in the art which are compatible with the other bath constituents. Such surfactants, when employed, can be used in amounts up to about 5 g/l.

The accelerating solution can be employed at temperatures ranging from about room temperature (65° F.) to temperatures below boiling point of the solution. Ordinarily, the accelerating solution is contained in treating tanks incorporating a protective plastisol lining and for practical consideration, temperatures up to about 160° F. are employed to avoid any thermal degradation or decomposition of such protective linings. In accordance with a preferred practice, the aqueous accelerating solution is employed at temperatures ranging from about 135° F. up to about 150° F. which provides for reasonable treating times consistent with the available operating cycle time of the continuous plating system.

The aqueous accelerating solution can be applied to the activated plastic substrate by any one of a variety of techniques of which immersing the plastic parts in the solution constitutes a preferred practice. Generally, immersion times from about 15 seconds up to about 30 minutes can be employed while time periods ranging from about 30 seconds up to about 5 minutes employing solutions at a temperature of about 135° F. to about 150° F. are satisfactory for most plastic materials and part configurations. The specific time period will vary somewhat depending upon the nature of the plastic material, the degree of activation of the polymeric substrates and the temperature of the solution. Typically, for ABS type plastics, accelerating treatments of from about 30 seconds to about 90 seconds at temperatures of 135° to about 150° F. are satisfactory.

In order to further illustrate the process of the present invention, the following examples are provided. It will be understood that these examples are provided for illustrative purposes and are not intended to be limiting of the scope of the invention as herein described and as set forth in the subjoined claims.

EXAMPLE 1

A series of test panels of a nominal size of about 3 inches by about 4 inches by 1/10th inch thick comprised of a platable ABS plastic are subjected to a pretreatment and electroless plating as hereinafter described. One set of such panels is comprised of a ABS plastic commercially available under the designation PG 298 from Monsanto Chemical while another ABS plastic was employed commercially available under the designation EP-3510 Marbon Cycolac from Borg-Warner Chemicals. In addition, test parts comprised of a modified polyphenylene oxide resin were also processed. The polyphenylene oxide resin is commercially available under the designation Noryl TN-235 from General Electric Company.

After appropriate cleaning, the plastic panels and parts are etched in an aqueous acid solution containing 356 g/l chromic acid, 412 g/l sulfuric acid and 0.2 g/l of a perfluorinated proprietory wetting agent commercially available under the designation FC-98 from Minnesota Mining and Manufacturing Company. The parts and panels were immersed for a period of five minutes in the aqueous etching solution maintaining at 160° F. while undergoing an air agitation. At the conclusion of the etching treatment, the parts and panels were removed and cold water rinsed with tap water for a period of 30 seconds. The rinsed parts are thereafter neutralized in an aqueous solution containing 18 g/l hydrochloric acid, 3 g/l hydroxyl amine sulfate. The neutralization treatment is carried out for one minute with air agitation at a solution temperature of about 100° F.

After neutralization the panels and parts are cold water rinsed and are subjected to an activation treatment in an aqueous acid solution containing 0.77 g/l palladium, 9 g/l tin chloride, 35.2 g/l hydrochloric acid and 192 g/l sodium chloride. An activation treatment of about 3 minutes at a solution temperature of 90° F. is employed. Thereafter the parts are cold water rinsed with tap water and are subjected to an accelerating solution hereinafter described.

After acceleration the parts are again cold water rinsed and subjected to an electroless plating step to apply a nickel plate thereover employing an aqueous bath containing 12 g/l nickel chloride hexahydrate [$NiCl_2.6H_2O$], 18 g/l of sodium hypophosphite [$NaH_2PO_2.H_2O$], and 9 g/l citric acid. The electroless plating is performed at about 85° F. for a period of about 5 minutes. The electroless plated parts are extracted from the solution, are cold water rinsed and thereafter are inspected to examine the nature of the electroless plating obtained.

In accordance with the present example, the aqueous acceleration solution employed is formulated by dissolving 1 gram of the tetra sodium salt of ethylene diamine tetra-acetic acid in one liter of de-ionized water together with 45 g/l sulfuric acid, 40 g/l sodium chloride and 1 g/l hydroxyl ammonium sulfate. The plastic parts and test panels are immersed in this accelerating solution for a period of one and one half minutes at a temperature of 130° F. in the presence of air agitation.

The resultant nickel electroless plated parts and panels produced as hereinabove set forth are inspected and are observed to contain a lustrous, uniform metal deposit.

EXAMPLE 2

ABS test panels and parts comprised of the modified polyphenylene oxide polymer as described in example 1 are accelerated in an aqueous acid accelerating solution containing 30 g/l sulfuric acid, 15 g/l of sodium chloride and N,N,N',N'-Tetrakis (2-hydroxy propyl)-ethylene diamine. The activated and water rinsed plastic panels and parts are immersed in this accelerator solution for 1.5 minutes at 130° F. in the presence of air or mechanical agitation. The resultant parts and panels at the completion of the nickel electroless plating step are observed to contain lustrous, uniform metallic nickel deposits.

By employing de-ionized water for preparing the accelerator solution, no contaminating ferric or cupric ions are present. It was observed that similar good electroless nickel deposits are obtained employing such solution without incorporating the substituted alkyl amine. However, by an addition of 20 mg/l of trivalent iron introduced by way of ferric chloride to the solution, the nickel electroless plating coverage is reduced by approximately 90%. In contrast, when an equivalent 20 mg/l of trivalent iron is introduced in the accelerator solution containing the substituted alkyl amine, the electroless nickel plating coverage is only reduced by about 10%.

EXAMPLE 3

The same plastic panels and parts as described in Example 1 were processed in accordance with the sequence described in Example 1 with the exception that an accelerator solution is employed containing 30 g/l sulfuric acid, 15 g/l sodium chloride and 2 g/l of the tetra-sodium salt of ethylene diamine tetra-acetic acid (EDTA). The plastic test panels and parts are immersed in this accelerator solution for time periods of 30 seconds up to 30 minutes at temperatures varying from 70° up to 150° F. In all cases, lustrous, uniform metallic nickel deposits are rapidly formed during the subsequent electroless plating step.

The aqueous accelerating solution is further modified by the addition of 200 mg/l of cupric ions introduced by way of copper chloride and 10 mg/l of ferric ions introduced by way of ferric chloride. Satisfactory electroless nickel plating are again obtained and it is observed that no rack plating occurred on the plastisol protective rack coating during the electroless plating operations.

Another aqueous accelerator solution is prepared as before but omitting the substituted alkyl amine. Processing of test panels and plastic parts through the sequence as described in Example 1 results in a 50% to a 100% rack plating during the subsequent nickel electroless plating step. The further addition of 200 mg/l per liter of cupric ions and 10 mg/l of ferric ions to the accelerator solution devoid of the substituted alkyl amine resulted in substantially no nickel deposits on the test panels and parts.

EXAMPLE 4

A fourth series of test panels and plastic parts are processed through the sequence as described in Example 1 with the exception that an aqueous accelerator solution is employed containing 40 g/l sulfuric acid, 15 g/l sodium chloride and 10 g/l glycine. During the accelerating step, the test panels and plastic parts are immersed for a period of 90 seconds at 130° F. The panels and parts at the completion of the electroless plating step are observed to contain lustrous, uniform metallic nickel deposits. The addition of 20 mg/l of ferric ions to the accelerator solution did not significantly affect the quality of the electroless nickel deposits obtained. However, the addition of an equivalent quantity of ferric ions to the accelerator solution of this example devoid of the glycine additive resulted in little or no metallic nickel plating at all on the test panels and parts at the conclusion of the electroless plating step.

EXAMPLE 5

A fifth series of test panels and plastic parts are processed through the sequence as described in Example 1 with the exception that an aqueous accelerator solution is employed containing 50 g/l sodium bisulfate, 58 g/l sodium chloride and 0.016 g/l of the tetra-sodium salt of EDTA.

The acceleration step is performed employing the foregoing accelerating solution for a period of 90 seconds at a temperature of 130° F. Lustrous, uniform nickel metal deposits are obtained during the subsequent electroless nickel plating step.

The foregoing excellent results are obtained in spite of the fact that the commercial grade of sodium bisulfate employed incorporated 0.0276% by weight iron as a normal contaminant. Accordingly, the accelerating solution contained 13.8 mg/l of ferric ions.

A similar accelerating solution is prepared but without the addition of the substituted alkyl amine. In this instance, the resultant test panels and plastic parts at the conclusion of the electroless plating step are observed to incorporate dark deposits of low metal integrity and plate coverage of only about 85% of the plastic surface is obtained. By the addition of 5 mg/l of cupric ions to this same solution, the plating coverage was further reduced to only 70%. The addition of 10 mg/l of cupric ions caused a further reduction in nickel plating coverage to only 10% of the surface of the panels and parts. The further addition of cupric ions to provide a final concentration of 20 mg/l resulted in a nickel plating coverage of substantially zero. However, by the addition of 1 g/l of the tetra-sodium salt of EDTA to this solution containing 20 mg/l of cupric ions and the 13.8 mg/l of ferric ions resulted in an immediate restoration of the electroless nickel deposits providing for coverages of at least about 98% to 100% of the plastic surfaces.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. In a process for treating a polymeric plastic substrate to render it receptive to electroless plating including the steps of etching the substrate with an aqueous acid solution containing hexavalent chromium ions, rinsing and activating the etched substrate with an acidic tin-palladium complex, rinsing and accelerating the activated substrate, the improvement comprising contacting the activated substrate during the accelerating step with an aqueous acidic accelerating solution having a pH of about 0 to about 7 and containing an aqueous soluble compatible substituted alkyl amine present in an amount effective to complex substantially all of any contaminating cupric and ferric ions present and to extract any residual tin constituents present on the surface of the activated substrate, an anion of a mineral acid or alkali metal salts thereof present in an amount up to about 120 g/l, said substituted alkyl amine corresponding to the following structural formula:

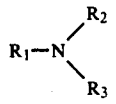

Wherein:

$R_1$ is an organic radical $$[\overset{|}{R}CHCOOH],\ [\overset{|}{R}CHCH_2OH],\ +CH_2CH_2N_R\overset{|}{+}_x-R,$$

$$\text{or } [HOOC\overset{|}{C}H\ CH_2(S)_yCH_2CHNH_2COOH]$$

in which x and y = 1 to 4;

R, $R_2$ and $R_3$ is H or $+CH_2]_zX$ in which z = 1 to 6 and X is —OH, —$SO_3H$, —COOH, —$NH_2$, halide, —$CH_3$, or —$OCH_3$, as well as the alkali metal salts of the foregoing.

2. The process as defined in claim 1 in which said substituted alkyl amine is present in an amount of from about 0.001 to about 100 g/l.

3. The process as defined in claim 1 in which said substituted alkyl amine is present in an amount of about 0.01 to about 10 g/l.

4. The process as defined in claim 1 in which said anion is selected from the group consisting of a halogen, sulfate, bisulfate and mixtures thereof.

5. The process as defined in claim 1 in which said aqueous accelerating solution further contains an effective amount of an aqueous soluble bath compatible reducing agent to reduce any residual hexavalent chromium ions present to the trivalent state.

6. The process as defined in claim 5 in which said reducing agent comprises a hydroxylamine salt.

7. The process as defined in claim 6 in which the hydroxylamine salt is present in an amount of about 0.005 to about 10 g/l.

8. The process as defined in claim 7 in which the hydroxylamine salt is selected from the group consisting of hydroxylamine hydrochloride, hydroxylammonium acid sulfate, hydroxylammonium sulfate and mixtures thereof.

9. The process as defined in claim 1 in which said anions are present in an amount of about 40 to about 90 g/l.

10. The process as defined in claim 1 in which said substituted aliphatic amine is ethylenediaminetetraacetic acid as well as the mono, di, tri and tetra alkali metal salts thereof.

* * * * *